US008986020B2

(12) United States Patent
Ishii

(10) Patent No.: US 8,986,020 B2
(45) Date of Patent: Mar. 24, 2015

(54) INTER-TERMINAL CONNECTION STRUCTURE

(71) Applicant: Hirose Electric Co., Ltd., Tokyo (JP)

(72) Inventor: Kentaro Ishii, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 142 days.

(21) Appl. No.: 13/875,441

(22) Filed: May 2, 2013

(65) Prior Publication Data

US 2013/0295799 A1 Nov. 7, 2013

(30) Foreign Application Priority Data

May 7, 2012 (JP) ..... 2012-105640

(51) Int. Cl.

| | |
|---|---|
| ***H01R 12/00*** | (2006.01) |
| ***H01R 11/01*** | (2006.01) |
| ***H01R 12/71*** | (2011.01) |
| ***H01R 12/73*** | (2011.01) |
| ***H01R 13/11*** | (2006.01) |

(52) U.S. Cl.

CPC ..... *H01R 11/01* (2013.01); *H01R 12/718* (2013.01); *H01R 12/732* (2013.01); *H01R 13/11* (2013.01); *Y10S 439/952* (2013.01)

USPC ..... 439/65; 439/511; 439/952

(58) Field of Classification Search

CPC ..... H01R 13/113; H01R 12/52

USPC ..... 439/507, 511, 512, 513, 65, 776, 952, 439/862

See application file for complete search history.

(56) References Cited

U.S. PATENT DOCUMENTS

| | | | | | |
|---|---|---|---|---|---|
| 3,162,501 | A | * | 12/1964 | Wahl | 439/399 |
| 3,245,024 | A | * | 4/1966 | Evans | 439/67 |
| 3,346,834 | A | * | 10/1967 | Kinkaid | 439/723 |
| 4,545,638 | A | * | 10/1985 | Neidich | 439/787 |
| 5,024,610 | A | * | 6/1991 | French et al. | 439/857 |
| 5,257,941 | A | * | 11/1993 | Lwee et al. | 439/65 |
| 5,387,111 | A | * | 2/1995 | DeSantis et al. | 439/65 |
| 5,416,461 | A | * | 5/1995 | Totsuka et al. | 337/261 |
| 5,628,557 | A | * | 5/1997 | Huang | 362/249.14 |
| 6,031,730 | A | * | 2/2000 | Kroske | 361/784 |
| 6,099,322 | A | * | 8/2000 | Beloritsky et al. | 439/63 |
| 6,123,587 | A | * | 9/2000 | Beloritski et al. | 439/857 |
| 6,383,039 | B1 | * | 5/2002 | Yoneyama et al. | 439/856 |

(Continued)

FOREIGN PATENT DOCUMENTS

| | | | |
|---|---|---|---|
| JP | 2010-010024 | A | 1/2010 |
| JP | 2012-043764 | A | 3/2012 |

*Primary Examiner* — Ross Gushi

(74) *Attorney, Agent, or Firm* — Kubotera & Associates, LLC

(57) ABSTRACT

An inter-terminal connection structure includes a circuit board terminal to be mounted on a circuit board; and a connection connector for connecting the circuit board terminal. The circuit board terminal includes a base portion, a pair of contact pieces extending from the base portion, and a pair of locking pieces extending from the base portion. Each contact pieces includes an elastic arm portion, and each locking pieces includes a locking portion having a locking protrusion. The connection connector includes a connection terminal having a plate shape portion sandwiched between the contact pieces and the locking pieces, and a housing that holds the connection terminal. The plate shape portion includes a locked portion, so that the locking protrusion is situated in the locked portion with a play to be movable when the connection connector is attached to the circuit board terminal.

6 Claims, 6 Drawing Sheets

(56) References Cited

U.S. PATENT DOCUMENTS

| | | | | |
|---|---|---|---|---|
| 7,153,157 | B2 * | 12/2006 | Robinson et al. | 439/508 |
| 7,160,145 | B2 * | 1/2007 | Barrat et al. | 439/511 |
| 7,258,562 | B2 * | 8/2007 | Daily et al. | 439/290 |
| 7,341,476 | B2 * | 3/2008 | Soeta | 439/493 |
| 7,425,145 | B2 * | 9/2008 | Ngo | 439/290 |
| 7,458,839 | B2 * | 12/2008 | Ngo et al. | 439/291 |
| 7,618,283 | B1 * | 11/2009 | Costello | 439/511 |
| 7,726,982 | B2 * | 6/2010 | Ngo | 439/79 |
| 7,762,857 | B2 * | 7/2010 | Ngo et al. | 439/856 |
| 7,841,860 | B1 * | 11/2010 | Chen | 439/65 |
| 7,892,050 | B2 * | 2/2011 | Pavlovic et al. | 439/839 |
| 7,905,731 | B2 * | 3/2011 | Ngo et al. | 439/75 |
| 7,963,796 | B2 * | 6/2011 | Sypolt et al. | 439/511 |
| 7,967,648 | B2 * | 6/2011 | Byrne | 439/856 |
| 8,062,046 | B2 * | 11/2011 | Daily et al. | 439/290 |
| 8,187,017 | B2 * | 5/2012 | Daily et al. | 439/290 |
| 8,339,235 | B2 * | 12/2012 | Beckert et al. | 337/198 |
| 8,366,497 | B2 * | 2/2013 | Glick et al. | 439/839 |
| 8,475,000 | B2 * | 7/2013 | Tamai | 362/249.04 |
| 8,616,926 | B2 * | 12/2013 | Byrne | 439/861 |
| 8,764,497 | B2 * | 7/2014 | Fehling et al. | 439/862 |
| 2001/0027050 | A1 * | 10/2001 | Ruiz et al. | 439/387 |
| 2004/0147177 | A1 * | 7/2004 | Wagner | 439/855 |
| 2005/0003702 | A1 * | 1/2005 | Obata et al. | 439/507 |
| 2006/0003620 | A1 * | 1/2006 | Daily et al. | 439/295 |
| 2006/0128197 | A1 * | 6/2006 | McGowan et al. | 439/212 |
| 2007/0275586 | A1 * | 11/2007 | Ngo | 439/290 |
| 2007/0298641 | A1 * | 12/2007 | Yamamoto et al. | 439/260 |
| 2008/0248670 | A1 * | 10/2008 | Daily et al. | 439/290 |
| 2010/0210152 | A1 * | 8/2010 | Byrne | 439/856 |
| 2010/0304605 | A1 * | 12/2010 | Osada | 439/507 |
| 2012/0020088 | A1 * | 1/2012 | Tamai | 362/249.02 |
| 2012/0083171 | A1 * | 4/2012 | Byrne | 439/888 |
| 2013/0295799 | A1 * | 11/2013 | Ishii | 439/884 |

* cited by examiner

INTER-TERMINAL CONNECTION STRUCTURE

BACKGROUND OF THE INVENTION AND RELATED ART STATEMENT

The present invention relates to an inter-terminal connection structure, and a board terminal and a connection connector thereof. More specifically, the present invention relates to an inter-terminal connection structure for electrically connecting a conductive member to be connected to a connection connector to a board terminal mounted on a circuit board through a connection terminal of the connection connector.

Patent Reference has disclosed a conventional inter-terminal connection structure. In the inter-terminal connector structure disclosed in Patent Reference, a receptacle terminal (a board terminal) is mounted on each of two circuit boards placed on a same level plane. A plug connector provided with a plug terminal (a connection terminal) having a plate shape is configured to connect the receptacle terminals in a state that the receptacle terminals are arranged along one direction, so that the receptacle terminals are electrically connected. The plug terminal is arranged such that a plate surface of the plug terminal is aligned with a plane perpendicular to a surface of the circuit board, so that the plug terminal saddles between the two circuit boards. Then, the plug connector is attached to the receptacle terminals from above.

Patent Reference: Japanese Patent Publication No. 2012-043764

In the conventional inter-terminal connection structure disclosed in Patent Reference, the receptacle terminal includes a base portion disposed to face the corresponding circuit board and extending an arrangement direction of the receptacle terminal. The receptacle terminal further includes a pair of first sandwiching pieces as a locking portion and a pair of second sandwiching pieces as a contact portion extending from the base portion. The first sandwiching pieces have an engaging protrusion as a locking protrusion, and the second sandwiching pieces have a sandwiching protrusion as a contact protrusion.

Further, in each of the receptacle terminals, the first sandwiching pieces and the second sandwiching pieces have one thereof situated on one surface side and another thereof situated on the other surface side of the plug terminal with the plate shape, and they are arranged at positions shifted with each other in the arrangement direction. In other words, the four sandwiching pieces, that is, the pair of the first sandwiching pieces and the pair of the second sandwiching pieces are arranged in a staggered arrangement pattern, so that the first sandwiching pieces is situated at shifted positions between the second sandwiching pieces in the arrangement direction.

In the conventional inter-terminal connection structure disclosed in Patent Reference, as described above, the pair of the first sandwiching pieces and the pair of the second sandwiching pieces of the receptacle terminal are situated at the shifted positions on both sides of the surface of the plug terminal in the arrangement direction, so that the first sandwiching pieces and the second sandwiching pieces sandwich the plug terminal with the plate shape of the plug connector. As a result, the first sandwiching pieces and the second sandwiching pieces contact with the one surface and the other surface of the plug terminal at the different locations in the arrangement direction.

In the conventional inter-terminal connection structure disclosed in Patent Reference, as described above, the plug terminal of the plug connector is formed in the plate shape extending in the arrangement direction. The plug terminal is configured to contact with the receptacle terminals sandwiching the plug connector at both end portions thereof. At the same time, the plug terminal is locked in a connector pull out or insertion direction. More specifically, at the both end portions of the plug terminal, the plate surface situated at a position corresponding to the sandwiching protrusions (the contact protrusions) of the second sandwiching pieces is configured to function as a corresponding contact portion. Further, the both end portions of the plug terminal, though holes as a locked portion are formed in the plug connector at a position corresponding to engaging protrusions (locking protrusions) of the first sandwiching pieces for engaging with the engaging protrusions.

In general, the receptacle terminals may be shifted from a standard position relative each other in a width direction of the receptacle terminal (a direction perpendicular to the arrangement direction and the connector pull out or insertion direction) due to a deviation of the placement of the circuit board or the mounting position of the receptacle terminal relative to the circuit board.

In the conventional inter-terminal connection structure disclosed in Patent Reference, as described above, the first sandwiching pieces and the second sandwiching pieces press against and contact with the both surfaces of the plug terminal at the different locations in the arrangement direction. Accordingly, when the receptacle terminals are shifted in the width direction thereof, a middle portion of the plug terminal in the arrangement direction is configured to be deformed elastically in the width direction to absorb the shift of the receptacle terminals, so that the connection state between the receptacle terminals is maintained.

In the conventional inter-terminal connection structure disclosed in Patent Reference, as described above, when the plug connector is connected to the receptacle terminals, the plug terminal is configured to be deformed elastically to absorb the shift of the receptacle terminals in the width direction. Accordingly, as long as the connection state is maintained, in which the plug terminal is deformed elastically to absorb the shift of the receptacle terminals, a stress is applied to the plug terminal for a long period of time due to the elastic deformation, thereby causing damage in the plug terminal. Further, when the plug terminal is deformed elastically, it is difficult to maintain the connection state between the plug terminal and the receptacle terminals, thereby deteriorating contact reliability between plug terminal and the receptacle terminals.

Further, in the conventional inter-terminal connection structure disclosed in Patent Reference, even when a cable or the plug terminal having other conductive member is connected to the receptacle terminal mounted on the circuit board as the board terminal, it is difficult to prevent the problem due to the elastic deformation of the plug terminal in the connection state, as far as the first sandwiching pieces and the second sandwiching pieces of the receptacle terminal press against and contact with the both surfaces of the plug terminal at the different locations in the arrangement direction.

In view of the problems described above, an object of the present invention is to provide an inter-terminal connection structure capable of solving the problems of the conventional inter-terminal connection structure. Another object of the present invention is to provide a board terminal and a connection connector of the inter-terminal connection structure. In the inter-terminal connection structure of the present invention, it is possible to prevent a connection terminal of the connection connector from being damaged even when the board terminal and a conductive member are shifted from a standard position, and to maintain a good connection state between the board terminal and the connection terminal.

Further objects and advantages of the invention will be apparent from the following description of the invention.

SUMMARY OF THE INVENTION

In order to attain the objects described above, according to a first aspect of the present invention, an inter-terminal connection structure includes a board terminal mounted on a circuit board and a terminal of a connection connector connected to the board connector in a connector pull out or insertion direction as a direction perpendicular to the circuit board. As a result, a conductive member connected to the terminal of the connection connector is electrically connected to the board terminal.

According to the first aspect of the present invention, in the inter-terminal connection structure, the board terminal includes a base portion arranged to face the circuit board and having a side portion extending in a longitudinal direction thereof, a pair of contact pieces extending from both side portions of the base portion, and a locking pieces extending from the both side portions of the base portion. The contact pieces and the locking pieces have elastic arm portions capable of elastically deforming in a terminal width direction connecting the both side portions of the base portion viewed in the longitudinal direction. The elastic arm portions are formed in a curved shape, so that the elastic arm portions become close together in the terminal width direction. The elastic arm portions of the contact pieces are formed as contact portions, and the elastic arm portions of the locking pieces are formed as locking portions.

According to the first aspect of the present invention, in the inter-terminal connection structure, the connection connector includes a connection terminal having a plate shape portion inserted between the contact portions and the locking portions of the board terminal in the pull out or insertion direction viewed in the longitudinal direction. The connection connector further includes a housing for holding the connection terminal. The plate shape portion of the connection terminal has a plate surface perpendicular to the longitudinal direction and the terminal width direction. Further, the plate shape portion includes a corresponding contact portion contacting with the contact portions of the board terminal.

According to the first aspect of the present invention, in the inter-terminal connection structure, ones of the contact pieces and the locking pieces of the board terminal are situated on an edge portion side of the circuit board relative to the other ones in the longitudinal direction. Each of the locking portions of the locking pieces is provided with a locking protrusion approaching with each other in the terminal width direction viewed in the longitudinal direction. Further, the plate shape portion of the connection terminal includes a locked portion formed as a hole portion or a cut portion penetrating in the terminal width direction within a range including the locking protrusions of the board terminal in a connection state between the board terminal and the connection terminal in the longitudinal direction and the connector pull out or insertion direction. Accordingly, in the connection state, the contact portions of the contact pieces of the board terminal pressingly sandwich the corresponding contact portions of the connection terminal in the terminal width direction, so that the contact portions contact with the corresponding contact portions. At the same time, the locking protrusions of the locking pieces of the board terminal enter and are situated in the locked portion of the connection terminal with a play, so that the locking protrusions are movable in the terminal width direction.

According to the first aspect of the present invention, in the inter-terminal connection structure, ones of the contact pieces and the locking pieces of the board terminal are situated on the edge portion side of the circuit board relative to the other ones in the longitudinal direction. In other words, as opposed to the conventional inter-terminal connection structure, the contact pieces and the locking pieces do not have a mixed range in the longitudinal direction.

Further, the locking protrusions of the locking pieces of the board terminal enter and are situated in the locked portion of the connection terminal with a play, so that the locking protrusions are movable in the terminal width direction. In other words, the locking pieces regulate the connection terminal to be capable of locking in a non-sandwiched state.

As described above, according to the first aspect of the present invention, in the inter-terminal connection structure, the contact pieces and the locking pieces do not have the mixed range in the longitudinal direction, and the locking pieces regulate the connection terminal in the non-sandwiched state. Accordingly, when the board terminal and the conductive member are shifted from the standard position, the connection terminal is moved only to an inclined state relative to the standard position (the position where the connection terminal extends in the arrangement direction) in the terminal width direction while following the shift with the position of the corresponding contact portions sandwiched with the contact portions of the board terminal as a pivot, so that the connection terminal is not elastically deformed. As a result, a stress is not applied to the connection terminal, thereby preventing the connection terminal from being damaged. Further, it is possible to securely maintain the good connection state between the connection terminal and the board terminal.

According to a second aspect of the present invention, in the inter-terminal connection structure according to the first aspect, two circuit boards may be arranged such that edge portions thereof are situated next to each other. The board terminal having an identical configuration is disposed on each of the two circuit boards. The connection connector includes the corresponding contact portions and the locked portions on both end portions of the connection terminal. Accordingly, it is possible to connect the board terminal on one of the circuit boards to the board terminal on the other of the circuit boards as the conductive member on the other of the circuit boards with the connection terminal of the connection connector.

According to the second aspect of the present invention, the board terminal having an identical configuration is disposed on each of the two circuit boards. A circuit portion of the other of the circuit boards corresponds to the conductive member. The contact portions of the board terminals on the circuit boards are connected through the plate shape portion of the connection terminal of the connection connector. When one of the circuit boards and the other one of the circuit boards are shifted from a standard position, the connection terminal is inclined and moved to a position on a line between the contact portions of the board terminals on the two circuit boards without being elastically deformed. Accordingly, the locking portion enters the locked portion, so that it is possible to maintain the state capable of locking without a pressing force.

According to a third aspect of the present invention, in the inter-terminal connection structure according to the first aspect, the locking pieces of the board terminal may be situated on a position closer to the edge portion of the circuit board relative to the contact pieces in the longitudinal direction of the base portion.

According to the third aspect of the present invention, the locked portion is situated closer to the edge portion of the circuit board than the contact pieces. Accordingly, when the board terminal is shifted from the standard position, even if the locked portion is situated on the same inclined line as the contact portions, the locked portion is moved for a distance smaller than a deformation amount of the contact portions of the board terminal, thereby making it possible to prevent the locking pieces from coming off.

According to a fourth aspect of the present invention, in the inter-terminal connection structure according to the first aspect, the locking pieces of the board terminal may include a plurality of pairs disposed at different positions in the longitudinal direction of the base portion.

According to the fourth aspect of the present invention, the pairs of the locking pieces become independent with each other. Accordingly, when the circuit board is shifted and the inclined line becomes large, ones of the locking pieces are moved for a distance smaller than that of the other ones of the locking pieces, thereby securing the locking positions thereof.

According to a fifth aspect of the present invention, a board connector mounted on a circuit board is connected to connection connector a in a connector pull out or insertion direction as a direction perpendicular to the circuit board. As a result, a conductive member connected to the terminal of the connection connector is electrically connected to the board terminal.

According to the fifth aspect of the present invention, the board terminal includes a base portion arranged to face the circuit board and having a side portion extending in a longitudinal direction thereof, a pair of contact pieces extending from both side portions of the base portion, and a locking pieces extending from the both side portions of the base portion. The contact pieces and the locking pieces have elastic arm portions capable of elastically deforming in a terminal width direction connecting the both side portions of the base portion viewed in the longitudinal direction. The elastic arm portions are formed in a curved shape, so that the elastic arm portions become close together in the terminal width direction. The elastic arm portions of the contact pieces are formed as contact portions, and the elastic arm portions of the locking pieces are formed as locking portions.

According to the fifth aspect of the present invention, in the connection connector, ones of the contact pieces and the locking pieces of the board terminal are situated on an edge portion side of the circuit board relative to the other ones in the longitudinal direction. Each of the locking portions of the locking pieces is provided with a locking protrusion approaching with each other in the terminal width direction viewed in the longitudinal direction. Accordingly, in the connection state, the contact portions of the contact pieces of the board terminal pressingly sandwich the corresponding contact portions of the connection terminal in the terminal width direction, so that the contact portions contact with the corresponding contact portions. At the same time, the locking protrusions of the locking pieces of the board terminal enter and are situated in the locked portion of the connection terminal with a play, so that the locking protrusions are movable in the terminal width direction.

According to a sixth aspect of the present invention, a terminal of a connection connector is connected to a board connector mounted on a circuit board in a connector pull out or insertion direction as a direction perpendicular to the circuit board. As a result, a conductive member connected to the terminal of the connection connector is electrically connected to the board terminal.

According to the sixth aspect of the present invention, the connection connector includes a connection terminal having a plate shape portion inserted between the contact portions and the locking portions of the board terminal in the pull out or insertion direction viewed in the longitudinal direction. The connection connector further includes a housing for holding the connection terminal. The plate shape portion of the connection terminal has a plate surface perpendicular to the longitudinal direction and the terminal width direction. Further, the plate shape portion includes a corresponding contact portion contacting with the contact portions of the board terminal.

According to the sixth aspect of the present invention, in the connection connector, the plate shape portion of the connection terminal includes a locked portion formed as a hole portion or a cut portion penetrating in the terminal width direction within a range including the locking protrusions of the board terminal in a connection state between the board terminal and the connection terminal in the longitudinal direction and the connector pull out or insertion direction. Accordingly, in the connection state, the contact portions of the contact pieces of the board terminal pressingly sandwich the corresponding contact portions of the connection terminal in the terminal width direction, so that the contact portions contact with the corresponding contact portions. At the same time, the locking protrusions of the locking pieces of the board terminal enter and are situated in the locked portion of the connection terminal with a play, so that the locking protrusions are movable in the terminal width direction.

As described above, according to the present invention, when the board terminal and the conductive member are shifted from the standard position, the connection terminal is moved only to an inclined state relative to the standard position in the terminal width direction while following the shift with the position of the corresponding contact portions sandwiched with the contact portions of the board terminal as a pivot, so that the connection terminal is not elastically deformed. As a result, a stress is not applied to the connection terminal, thereby preventing the connection terminal from being damaged. Further, it is possible to securely maintain the good connection state between the connection terminal and the board terminal.

BRIEF DESCRIPTION OF THE DRAWINGS

FIGS. 5(A) and 5(B) are sectional views showing the board terminal and the connection connector of the inter-terminal connection structure in a state that the board terminal is connected to the connection connector according to the embodiment of the present invention, wherein FIG. 5(A) is a sectional view showing the connection connector of the inter-terminal connection structure taken along a line 5(A) in FIG. 1, and FIG. 5(A) is a sectional view showing the connection connector of the inter-terminal connection structure taken along a line 5(B) in FIG. 1.

DETAILED DESCRIPTION OF THE PREFERRED EMBODIMENTS

Figure 1:
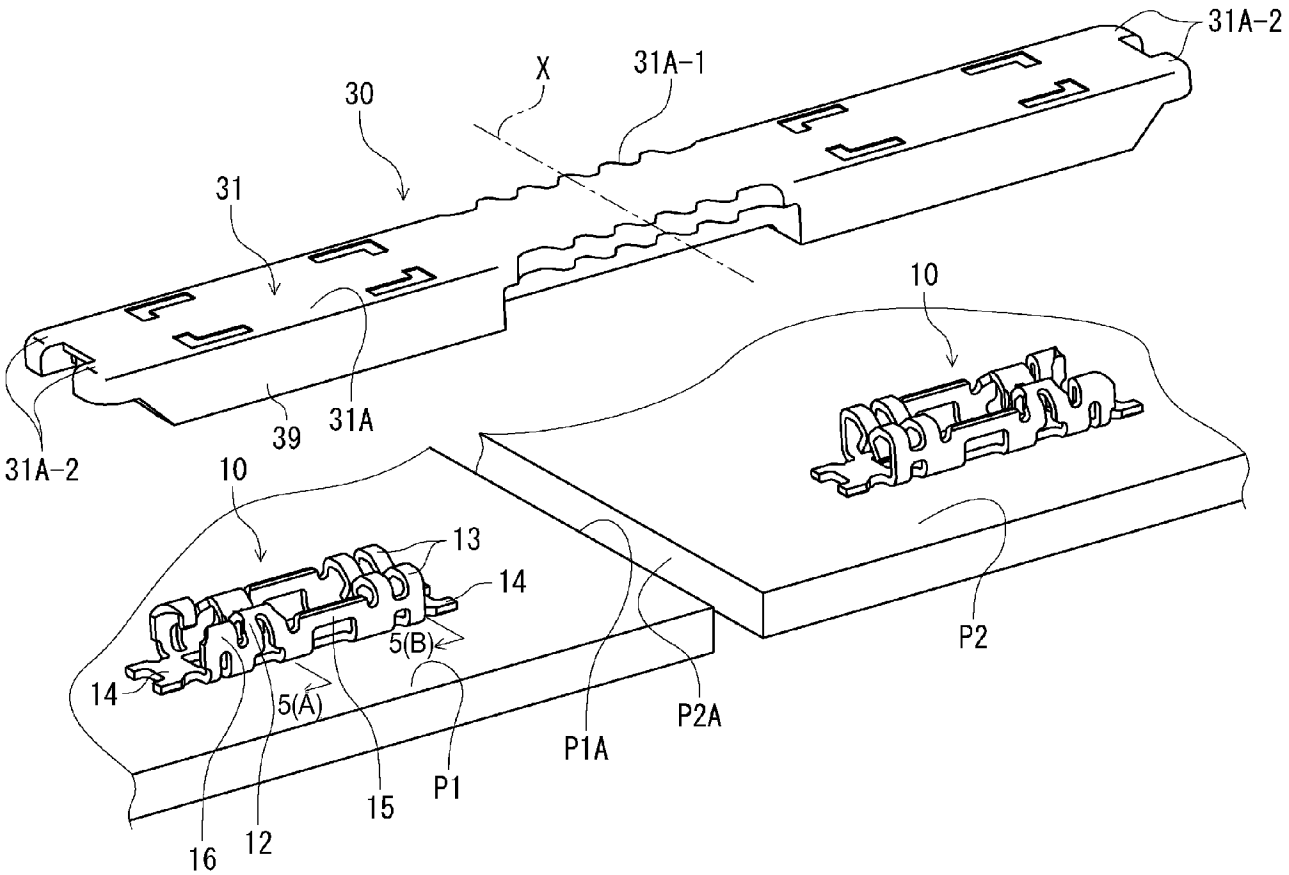
FIG. 1 is a perspective view showing a board terminal and a connection connector of an inter-terminal connection structure just before the board terminal is connected to the connection connector according to an embodiment of the present invention.

Hereunder, embodiments of the present invention will be explained with reference to the accompanying drawings. In the accompanying drawings, similar components are designated with the same reference numerals, and repeated explanations thereof are omitted.

FIG. 1 is a perspective view showing a board terminal 10 and a connection connector 30 of an inter-terminal connection structure just before the board terminal 10 is connected to the connection connector 30 according to an embodiment of the present invention.

As shown in FIG. 1, the board terminals 10 having an identical configuration are mounted on two circuit boards P1 and P2 such that the board terminals 10 are connected to corresponding circuit portions (not shown) on the circuit boards P1 and P2. Further, the connection connector 30 is to be connected to the board terminals 10 in a state that edge portions P1A and P2A of the circuit boards P1 and P2 face each other, so that the connection connector 30 connects the board terminals 10.

In the embodiment, it may be configured such that the connection connector 30 is arranged to connect the board terminal 10 on the circuit board P1 to a conductive member other than the board terminal 10 on the circuit board P2. The conductive member may include, for example, a cable to be connected to the connection connector 30 or other electric parts. As far as the connection connector 30 is capable of connecting two components, the conductive member is not limited to a specific one.

In the embodiment, the board terminals 10 on the circuit boards P1 and P2 have an identical configuration, and are arranged to face opposite each other in symmetry relative to the side edge portions P1A and P2A of the circuit boards P1 and P2. In the following description, only the board terminal 10 on the circuit board P1 will be explained in more detail. It should be noted that a direction along with the board terminals 10 are arranged is referred to as an arrangement direction of the board terminals 10. Further, the board terminals 10 are formed to have a longitudinal direction as one direction. In other words, the board terminals 10 are arranged in the longitudinal direction as the arrangement direction.

Figure 3:
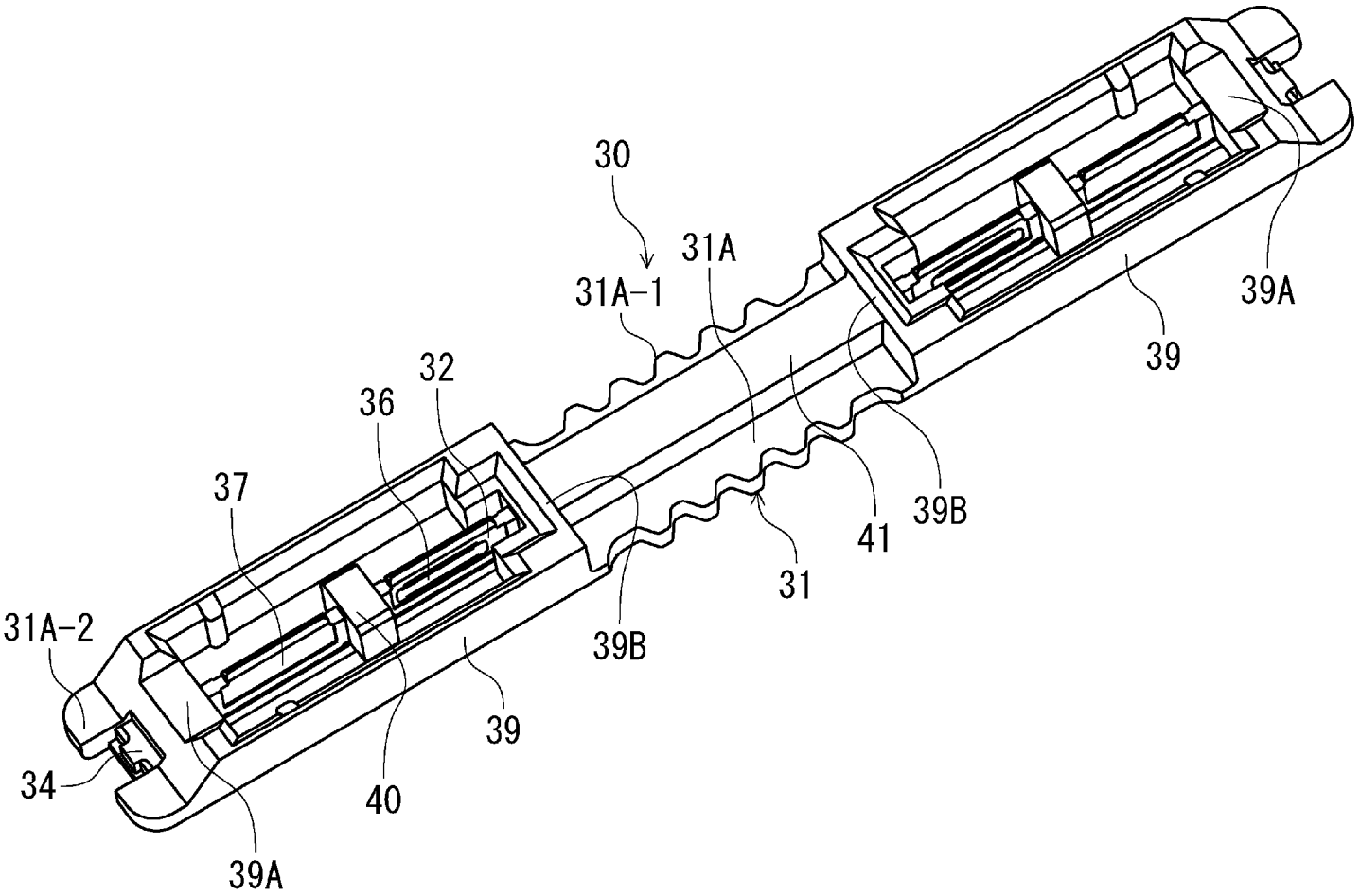
FIG. 3 is an enlarged perspective view showing the connection connector of the inter-terminal connection structure in an inverted state from FIG. 1 according to the embodiment of the present invention.

A configuration of the connection connector 30 will be explained in more detail. FIG. 3 is an enlarged perspective view showing the connection connector 30 of the inter-terminal connection structure in an inverted state from FIG. 1 according to the embodiment of the present invention.

As shown in FIG. 1 and FIG. 3 that shows the up side down (vertically) inverted state, the connection connector 30 includes a housing 31 formed of an electrically insulation material and a connection terminal 32 held with the housing 31. The housing 31 is arranged to extend in the arrangement direction of the board terminals 10 as the longitudinal direction thereof, and the connection connector 30 is arranged to extend in the longitudinal direction as well.

In the embodiment of the present invention, the connection connector 30 has a configuration symmetrical relative to a symmetrical line X situated at a center of the connection connector 30 in the longitudinal direction and extending perpendicular to the longitudinal direction. Accordingly, in the following description, one half of the connection connector 30 will be explained. When the connection connector 30 is connected to the board terminals 10, the symmetrical line X is situated in a space between the edge portions P1A and P2A of the circuit boards P1 and P2. Accordingly, the connection connector 30 having the symmetrical configuration relative to the symmetrical line X is arranged to saddle between the board terminals 10 on both sides of the edge portions P1A and P2A of the circuit boards P1 and P2.

Figure 4:
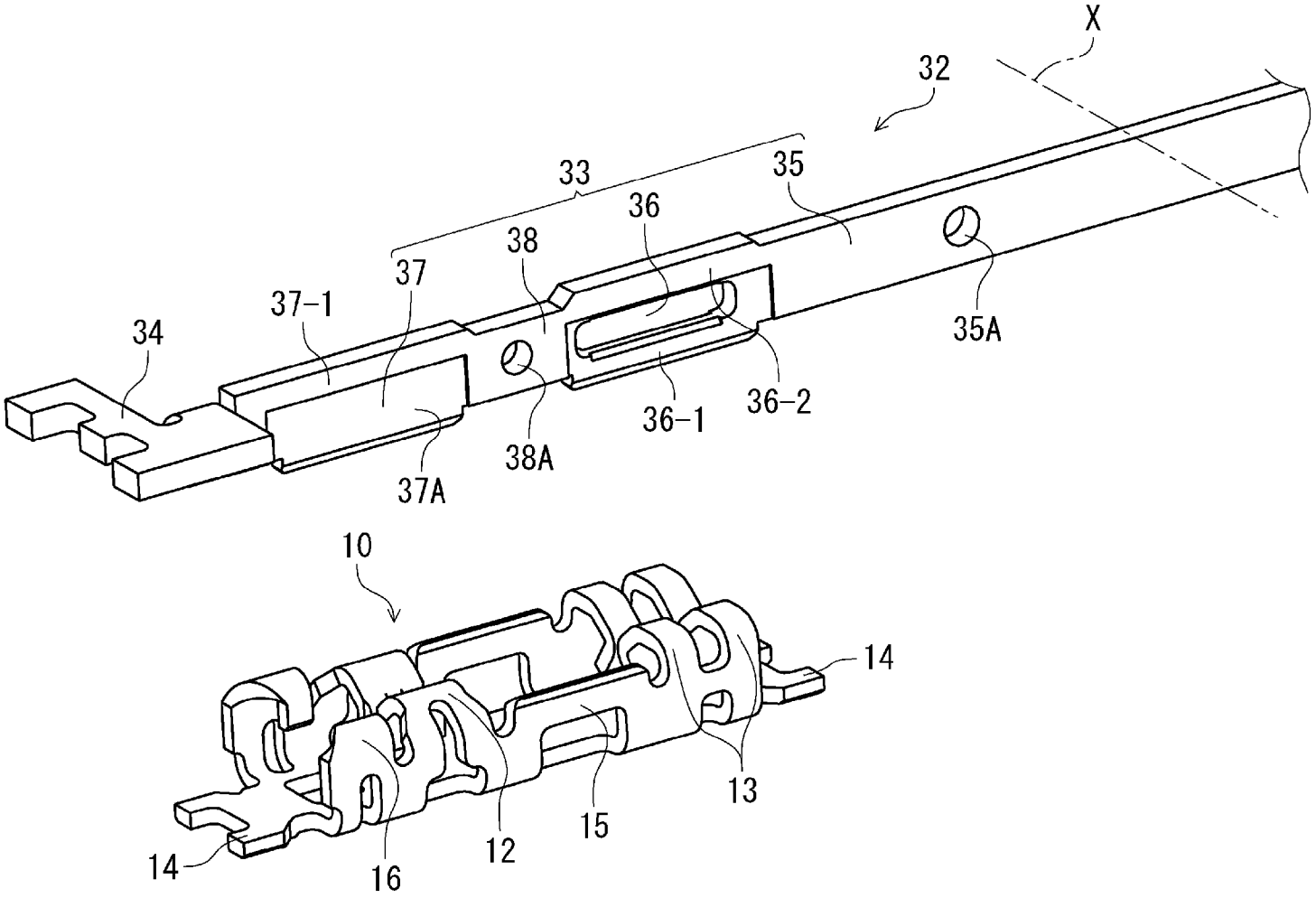
FIG. 4 is an enlarged perspective view showing the board terminal and the connection connector without a housing thereof of the inter-terminal connection structure just before the board terminal is connected to the connection connector according to the embodiment of the present invention.

FIG. 4 is an enlarged perspective view showing the board terminal 10 and the connection connector 30 without the housing 31 thereof of the inter-terminal connection structure just before the board terminal 10 is connected to the connection connector 30 according to the embodiment of the present invention.

As shown in FIG. 1 and FIG. 4, the connection terminal 32 is formed through processing a metal plate with a band shape. The connection terminal 32 includes a plate portion 33 extending in the longitudinal direction and having a band width in the vertical direction. Further, the connection terminal 32 includes an edge portion held portion 34 at both end portions of the plate portion 33 having a plate surface perpendicular to that of the plate portion 33 (one of the edge held portions 34 is not shown in FIG. 4).

In the embodiment, it is suffice that the connection terminal 32 includes the plate portion 33, and it may be configured such that a portion the connection terminal 32 is bent relative to the plate portion 33 as other portion including the edge portion held portion 34. For example, the connection terminal 32 may include a bent portion bent at an upper edge of the plate portion 33, so that the bent portion is embedded in the connection connector 30 to increase strength of the connection terminal 32 as a whole.

As shown in FIG. 4, the plate portion 33 includes a center held portion 35 with a band shape having a flat surface and extending on both sides of the symmetrical line X; a locked portion 36 formed as a hole portion between the center held portion 35 and the edge portion held portion 34; and a corresponding contact portion 37 for contacting with the board terminal 10. Further, the plate portion 33 includes an intermediate held portion 38 having a flat surface between the locked portion 36 and the corresponding contact portion 37.

In the embodiment, a surrounding portion (a portion forming an inner circumferential edge of the hole portion) of the locked portion 36 formed as the hole portion and the corresponding contact portion 37 are configured to have a width in the vertical direction larger than that of the center held portion 35 or the intermediate held portion 38. The locked portion 36 is formed as a long hole portion extending in the longitudinal direction and penetrating in the plate thickness direction. A lower portion 36-1 is disposed below the locked portion 36, and has an upper edge portion and a lower edge portion formed in a taper shape. With the tapered shape, it is possible to easily insert or pull out the lower portion 36-1 between a pair of locking pieces of the board terminal 10 (described later). Further, a surrounding portion of the locked portion 36 including the lower portion 36-1 is formed through a press molding to have a thickness slightly smaller than other portion.

In the embodiment, the corresponding contact portion 37 includes a corresponding contact surface 37A extending from an upper portion 37-1 thereof down to a lower edge thereof for contacting with a pair of contact pieces of the board terminal 10 (described later). The lower edge of the corresponding contact portion 37 is formed in a tapered shape, so that it is possible to easily insert the corresponding contact portion 37 between the contact pieces of the board terminal 10. Further, the corresponding contact surface 37A is formed through the press molding to have a thickness slightly smaller than that of other portion.

In the embodiment, the connection terminal 32 is integrally molded with the housing 31, so that the housing 31 holds the connection terminal 32. More specifically, the connection terminal 32 is integrally molded and held with the housing 31, so that the edge portion held portion 34, the center held portion 35, the intermediate held portion 38, the upper edge of the locked portion 36, and the upper edge of the corresponding contact portion 37 shown in FIG. 4 are embedded in the housing 31. It should be noted that the upper edge of the corresponding contact portion 37 is shown in FIG. 3 as the lower edge in an inverted posture. Accordingly, when the connection terminal 32 is integrally molded and held with the housing 31, the locked portion 36 and the corresponding contact portion 37 are not embedded in and are exposed from the housing 31.

In the embodiment, as described above, the housing 31 holds the connection terminal 32 at the upper edge thereof in the posture (at the position) of the connection terminal 32 shown in FIG. 4. Accordingly, as shown in FIG. 1, the housing 31 covers the upper portion of the connection connector 30. Further, the housing 31 includes an upper wall portion 31A forming a flat upper surface thereof; holding wall portions 39 formed in a rectangular shape at a lower portion of the upper wall portion 31A (an upper portion in FIG. 3 showing as the inverted state from FIG. 1) for surrounding the locked portion 36 and the corresponding contact portion 37 at the both end portions of the connection terminal 32; and intermediate holding portions 40 (refer to FIG. 3) formed in an island shape and disposed inside the holding wall portions 39 with the rectangular shape.

In the embodiment, the housing 31 further includes a center holding protruding portion 41 (refer to FIG. 3) on a lower surface of the upper wall portion 31A. The center holding protruding portion 41 extends in the longitudinal direction to connect the holding wall portions 39 with the rectangular shape at the both end portions of the housing 31. Further, the center holding protruding portion 41 is to be situated at the space between the edge portions P1A and P2A of the circuit boards P1 and P2, and the connection terminal 32 is not exposed at the center holding protruding portion 41. Accordingly, even when the circuit portions on the circuit boards P1 and P2 are exposed at the edge portions P1A and P2A, it is possible to prevent inadvertent electrical contact with the circuit portions on the circuit boards P1 and P2.

As shown in FIG. 3, the housing 31 further includes outer edge wall portions 39A arranged outside the holding wall portions 39 in the longitudinal direction, so that a majority portion of the edge portion held portion 34 of the connection terminal 32 is embedded in each of the outer edge wall portions 39A. The intermediate held portion 38 is embedded in the intermediate holding portions 40. Further, the center held portion 35 is embedded in the portion from an inner edge wall portion 39B of one of the holding wall portions 39 to the inner edge wall portion 39B of the other of the holding wall portions 39 through the center holding protruding portion 41. Accordingly, with the configuration described above, the housing 31 holds the connection terminal 32. As a result, the locked portion 36 and the corresponding contact portion 37 of the connection terminal 32 are situated and exposed inside the holding wall portions 39 with the rectangular shape.

In the embodiment, the housing 31 further includes an undulation portion 31A-1 having a wave shape on each of side edges of the upper wall portion 31A at the center thereof in the longitudinal direction. The undulation portion 31A-1 is provided for an operator to easily pick up the connection connector 30 when the connection connector 30 is connected to the board terminal 10. Further, the housing 31 includes protruding portions 31A-2 protruding from the both edges of the upper wall portion 31A in the longitudinal direction. The protruding portions 31A-2 are provided for hooking a finger of the operator when the connection connector 30 is pulled out from the board terminal 10.

Figure 2:
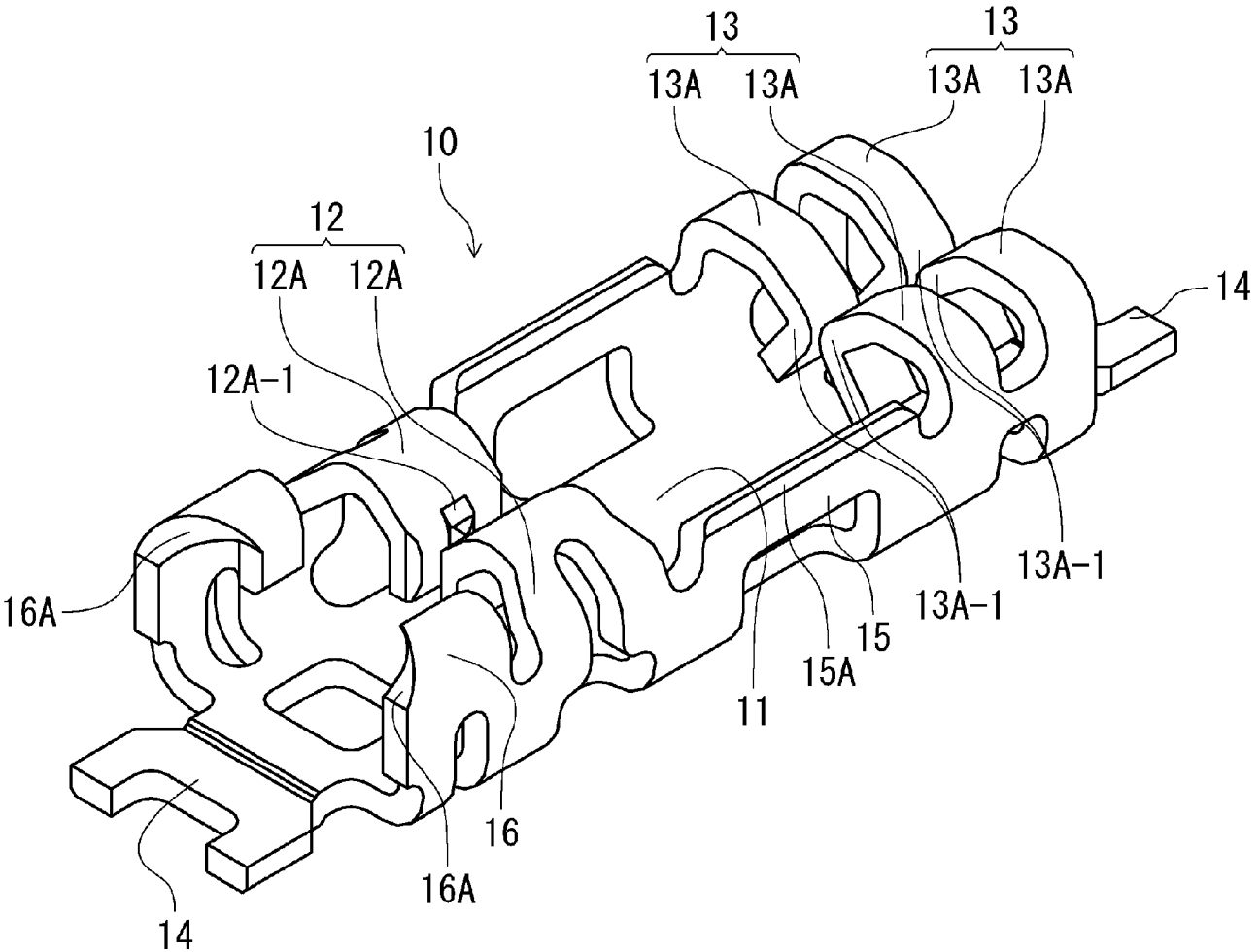
FIG. 2 is an enlarged perspective view showing the board terminal of the inter-terminal connection structure according to the embodiment of the present invention.

A configuration of the board terminal 10 will be explained in more detail next. FIG. 2 is an enlarged perspective view showing the board terminal 10 of the inter-terminal connection structure according to the embodiment of the present invention.

In the embodiment, when the board terminal 10 is produced, after a metal plate is punched out and machined, the metal plate is bent to have a shape as shown in FIGS. 1, 2 and 4. As described above, the board terminals 10 have the identical configuration, and FIG. 2 is the enlarged perspective view of one of the board terminals 10 arranged symmetrically with the symmetrical line X in between as shown in FIG. 1. In the following description, the configuration of the board terminal 10 will be explained with reference to FIG. 2.

As shown in FIG. 2, the board terminal 10 includes a base portion 11 having a plate surface extending in the longitudinal direction along the surface of the circuit board P1; the contact pieces 12 standing from side edges of the base portion 11; the locking pieces 13 similarly standing from the side edges of the base portion 11; and connecting portions 14 protruding from both end portions of the base portion 11.

In the embodiment, both the contact pieces 12 and the locking pieces 13 are formed to be capable of being elastically deformed. The board terminal 10 further includes width direction guiding walls 15 for connecting the contact pieces 12 and the locking pieces 13 such that the contact pieces 12 and the locking pieces 13 are capable of being freely deformd. The width direction guiding walls 15 are provided for guiding the intermediate holding portion 40 of the connection connector 30 when the connection connector 30 is connected to the board terminal 10. Further, the board terminal 10 includes longitudinal direction guiding walls 16 in a standing posture adjacent to the contact pieces 12 such that the contact pieces 12 are capable of being freely deformed. In the following description, each of the components of the board terminal 10 will be explained in more detail.

In the embodiment, the contact pieces 12 include contact portions 12A arranged to stand from both side edges of the base portion 11 in the width direction, respectively, such that the contact portions 12A face to each other and are arranged symmetrically. The contact portions 12A are formed as elastic arm portions capable of being elastically deformed in the width direction such that the contact portions 12A stand from the side edges of the base portion 11 to approach each other, and are curved downwardly. The contact portions 12A include contact protrusions 12A-1 at positions closest each other. The contact protrusions 12A-1 of the contact portions 12A are arranged to have a distance in between, so that the contact protrusions 12A-1 of the contact portions 12A are capable of sandwiching and pressing the corresponding contact portion 37 formed on the connection terminal 32 of the connection connector 30.

In the embodiment, the locking pieces 13 are disposed at two locations in the longitudinal direction, that is, two pairs. Similar to the contact pieces 12, each of the pairs of the locking pieces 13 is formed as elastic arm portions capable of being elastically deformed in the width direction such that the locking pieces 13 stand from the side edges of the base portion 11 to approach each other, and are curved downwardly. The elastic arm portions of the locking pieces 13 are provided as locking portions 13A. The locking portions 13A include locking protrusions 13A-1 at closest portions thereof. The locking protrusions 13A-1 as the closest portions are arranged such that a distance between the locking protrusions 13A-1 becomes smaller than the plate thickness of the surrounding portion of the locked portion 36 formed on the connection terminal 32 of the connection connector 30.

In the embodiment, when the connection connector 30 is connected to the board terminal 10, the locking protrusions 13A-1 of the locking pieces 13 are situated within a range of the locked portion 36 formed as the hole portions both in the longitudinal direction and the connector pull out or insertion direction. As described above, the distance between the locking protrusions 13A-1 becomes smaller than the plate thickness of the surrounding portion of the locked portion 36. Accordingly, when the connection connector 30 is connected to the board terminal 10, the locking protrusions 13A-1 are capable of entering inside the locked portion 36 without receiving any abutting force from the plate surface of the locked portion 36.

In the embodiment, the width direction guiding walls 15 are provided for connecting the contact pieces 12 and the locking pieces 13, and are configured to stand from the both side edges of the base portion 11. The width direction guiding walls 15 have upper edges situated outside relative to the contact pieces 12 and the locking pieces 13 in the width direction. When the connection connector 30 is connected to the board terminal 10, at the beginning or in the middle of connection, the upper edges of the width direction guiding walls 15 are situated inside the inner wall surfaces of the holding wall portions 39 of the connection connector 30 at both sides thereof in the width direction. Accordingly, the width direction guiding walls 15 are provided for guiding the connection connector 30 in the width direction.

In the embodiment, the width direction guiding walls 15 include tapered portions 15A at the upper edges thereof, so that it is possible to easily guide the connection connector 30 when the connection connector 30 is connected to the board terminal 10. With the configurations described above, when the connection connector 30 is connected to the board terminal 10, even if the connection connector 30 is shifted from the standard position in the width direction, the width direction guiding walls 15 can guide the connection connector 30 toward the standard position.

In the embodiment, the longitudinal direction guiding walls 16 are disposed adjacent to the contact pieces 12, and are curved to approach each other similarly to the contact pieces 12, except that the longitudinal direction guiding walls 16 are not situated as closely as the contact portions 12A of the contact pieces 12. Further, the longitudinal direction guiding walls 16 include slant surfaces 16A as plate thickness surfaces on side edges thereof farther from the contact pieces 12. The slant surfaces 16A are inclined in a direction approaching the contact pieces 12 toward distal end portions of the longitudinal direction guiding walls 16 (inwardly in the width direction). In other words, the slant surfaces 16A are formed as side edge surfaces extending from top portions of the longitudinal direction guiding walls 16 toward the base portion 11 and away from the contact pieces 12.

In the embodiment, when the connection connector 30 is connected to the board terminal 10, at the beginning or in the middle of connection, the slant surfaces 16A are situated inside the inner wall surfaces of the outer edge wall portions 39A arranged at the end portions of the holding wall portions 39 of the connection connector 30 in the longitudinal direction. Accordingly, top portions of the slant surfaces 16A can guide the inner wall surfaces of the outer edge wall portions 39A, and the contact points move toward the base portion 11 as the connection connector 30 enters the board terminal 10 further, so that the slant surfaces 16A guide the connection connector 30 in the longitudinal direction. When the board terminals 10 are mounted on both the circuit boards P1 and P2, the slant surfaces 16A of the board terminals 10 guide the holding wall portions 39 at the both end portions of the connection connector 30 in the longitudinal direction. Accordingly, when the connection connector 30 is shifted from the standard position in the longitudinal direction upon connection, the slant surfaces 16A arranged symmetrically guide the connection connector 30 toward the center to the standard position.

An operation of connecting the connection connector 30 to the board terminals 10 of the inter-terminal connection structure will be explained next.

First, as shown in FIG. 1, the board terminals 10 are placed on and fixed to the circuit boards P1 and P2 at specific locations thereon with solder and the like. Accordingly, the board terminals 10 on the circuit boards P1 and P2 are arranged with the edge portions P1A and P2A of the circuit boards P1 and P2 in between in the symmetrical arrangement. As a result, the board terminals 10 disposed at the specific locations of the circuit boards P1 and P2 are situated with the longitudinal direction thereof aligned with the arrangement direction. It should be noted that the board terminals 10 are fixed to the circuit boards P1 and P2 with solder at the connecting portions 14 at the both end portions of the board terminals 10.

In the next step, as shown in FIG. 1, the connection connector 30 is placed over the board terminals 10 on the circuit boards P1 and P2, which face each other at the specific locations. Then, the connection connector 30 is pushed downwardly toward the circuit boards P1 and P2 to insert into the board terminals 10.

In the embodiment of the present invention, when the connection connector 30 is pushed downwardly toward the circuit boards P1 and P2, the connection connector 30 is fitted into and connected to the board terminals 10. At the beginning of the connecting operation, the board terminals 10 guide the inner circumferential surface of the holding wall portions 39 with the rectangular shape formed on the housing 31 of the connection connector 30, thereby smoothly fitting the connection connector 30 into the board terminals 10. More specifically, in the width direction of the connection connector 30, the width direction guiding walls 15 of the board terminals 10 guide one of the inner wall surfaces of the holding wall portions 39 on the both sides in the width direction. In the longitudinal direction, the slant surfaces 16A of the longitudinal direction guiding walls 16 of the board terminals 10 guide the inner surfaces of the outer edge wall portions 39A of the holding wall portions 39. Accordingly, it is possible to smoothly insert the connection connector 30 into the board terminals 10 while correcting any shift thereof from the standard position in the width direction and the longitudinal direction.

Figure 5A:
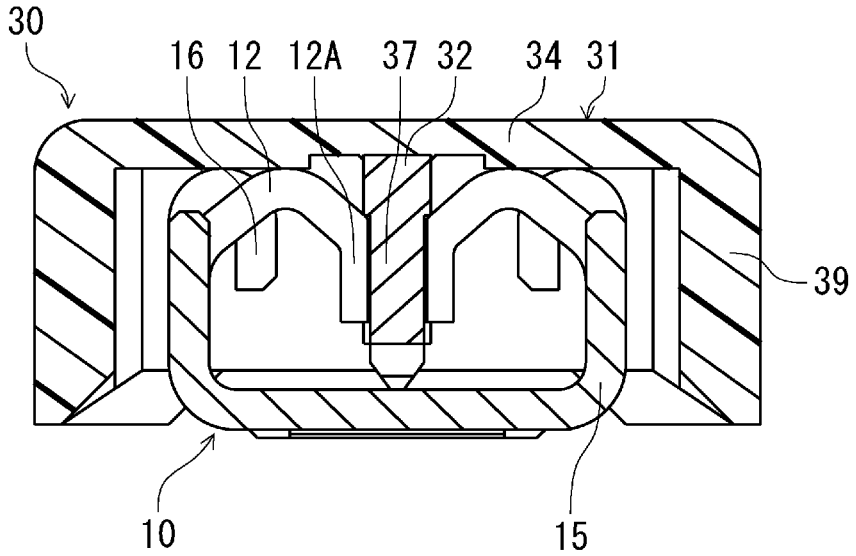
Figure 5B:
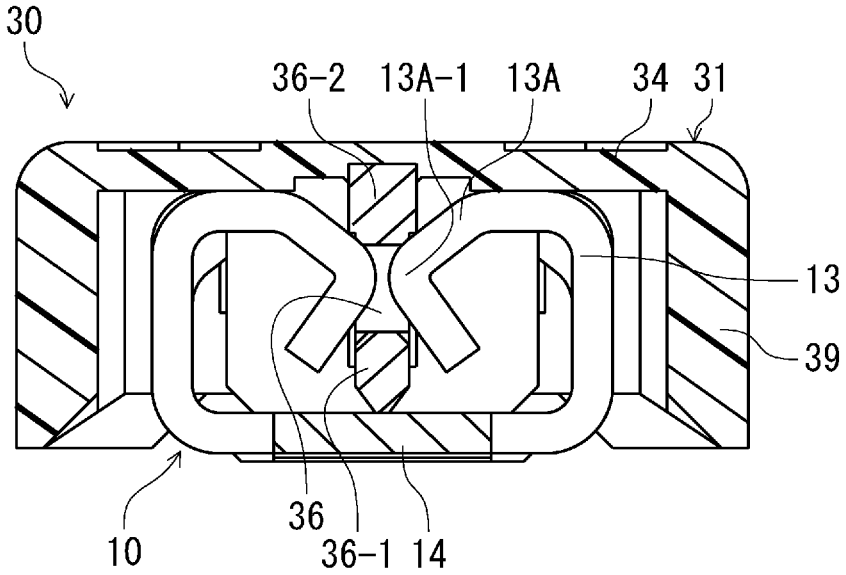

FIGS. 5(A) and 5(B) are sectional views showing the board terminal 10 and the connection connector 30 of the inter-terminal connection structure in a state that the board terminal 10 is connected to the connection connector 30 according to the embodiment of the present invention. More specifically, FIG. 5(A) is a sectional view showing the connection connector 30 of the inter-terminal connection structure taken along a line 5(A) in FIG. 1, and FIG. 5(A) is a sectional view showing the connection connector 30 of the inter-terminal connection structure taken along a line 5(B) in FIG. 1.

As shown in FIGS. 5(A) and 5(B), when the connection connector 30 is pushed downwardly to the standard engagement position, the corresponding contact portion 37 of the connection connector 30 contacts with the contact pieces 12 of the board terminals 10, and the lower portion 36-1 of the locked portion 36 engages with the locking pieces 13. More specifically, as shown in FIG. 5(A), the corresponding contact portion 37 enters between the contact pieces 12. In particular, the corresponding contact portion 37 is sandwiched and pressed through a point contact between the contact protrusions 12A-1 formed on the contact portions 12A of the contact pieces 12.

Further, as shown in FIG. 5(B), the lower portion 36-1 of the locked portion 36 pressingly enters between the locking portions 13A of the locking pieces 13. When the lower portion 36-1 of the locked portion 36 moves to the specific position, the locking protrusions 13A-1, i.e., the closest portions of the locking portions 13A, enter the locked portion 36, so that the locking portions 13A are released from the deformed state and become the free state.

In the embodiment of the present invention, as described above, the locking protrusions 13A-1 of the locking portions 13A are situated inside the locked portion 36 formed as the hole portion in the connection terminal 32 of the connection connector 30. Accordingly, in the longitudinal direction of the connection connector 30, the locking protrusions 13A-1 of the locking portions 13A are capable of abutting against the inner edge portions situated at the both edges of the locked portion 36 in the longitudinal direction. Further, in the connector pull out or insertion direction (the vertical direction), the locking protrusions 13A-1 of the locking portions 13A are capable of abutting against the inner edge portions situated at the upper and lower edges of the locked portion 36 in the connector pull out or insertion direction. As a result, the surrounding portion of the locked portion 36 is regulated in the vertical direction in the locked state without receiving the abutting force from the locking pieces 13.

Further, in the embodiment of the present invention, the inner edge portions at the upper edge and the lower edge of the locked portion 36 are capable of abutting against the surrounding portions of the locking protrusions 13A-1 of the locking portions 13A. Accordingly, the locked portion 36 of the connection terminal 32 with the plate shape is regulated in the width direction as well. Accordingly, in the connection connector 30, the corresponding contact portion 37 formed on the connection terminal 32 of the connection connector 30 contacts with the contact pieces 12 of the board terminals 10 through the point contact. Further, the surrounding portion of the locked portion 36 is maintained in the locked state without receiving the abutting force from the locking pieces 13.

In general, even if the board terminals 10 are accurately fixed to the circuit boards P1 and P2 at the specific position, when the circuit boards P1 and P2 are shifted from the standard position, the board terminals 10 may be shifted from the standard position as well. Especially, if the board terminals 10 are not accurately fixed to the circuit boards P1 and P2 at the specific position, the board terminals 10 may be shifted from the standard position to a greater extent. In the embodiment of the present invention, the inter-terminal connection structure is configured as described above to solve the above problem without applying an excessive stress to the board terminals 10 or the connection connector 30.

Figure 6:
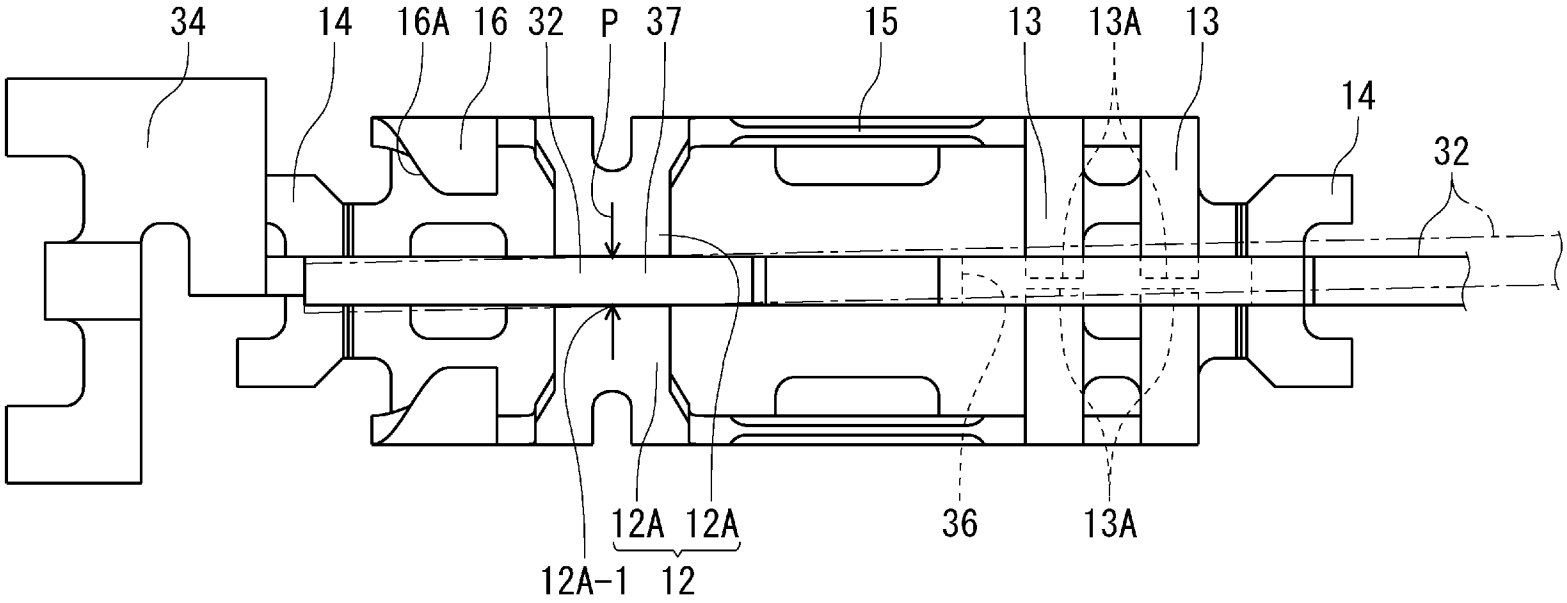
FIG. 6 is a plan view showing the board terminal and the connection connector of the inter-terminal connection structure in the state that the board terminal is connected to the connection connector at a standard position (represented with a solid line) and in a state that the board terminal is shifted relative to the connection connector from the standard position (represented with a projected line) according to the embodiment of the present invention.

FIG. 6 is a plan view showing the board terminal 10 and the connection connector 30 of the inter-terminal connection structure according to the embodiment of the present invention. As shown in FIG. 6, the connection terminal 32 of the connection connector 30 is connected to the board terminal 10 shown in the plan view (viewed in the connector pull out or insertion direction). Please note that only one of the board terminals 10 is shown, and the other one is omitted. In FIG. 6, the state that the connection terminal 32 of the connection connector 30 is connected to the board terminal 10 at the standard position is represented with a solid line, and a state that the board terminal 10 is shifted from the other one is represented with a projected line.

As shown in FIG. 6, when the board terminals 10 are situated at the standard position, the corresponding contact portion 37 of the connection terminal 32 contacts with the contact protrusions 12A-1 of the contact portions 12A through the pint contact with the contact pressure. A position of the point contact relative to one of the board terminals 10 is represented with an arrow P, and the point contact occurs at a similar position on the other of the board terminals 10 (not shown). Further, as represented with a hidden line in FIG. 6, the locking protrusions 13A-1 of the locking pieces 13 are situated within the locked portion 36 formed as the hole portion in the locked portion 36 of the connection terminal 32, so that the locking protrusions 13A-1 of the locking pieces 13 regulate the locked portion 36 without abutting against the connection terminal 32.

As shown in FIG. 6, the connection terminal 32 of the connection connector 30 contacts with the board terminal 10 through the pint contact. Accordingly, when the board terminals 10 are shifted with each other due to the positional shift of the circuit boards P1 and P2, or the fixing positional shift of the board terminals 10 relative to the circuit boards P1 and P2, the connection terminal 32 is inclined as shown in FIG. 6. In other words, the connection terminal 32 is sandwiched at the point contact positions at the both end portions the connection connector 30 in the longitudinal direction, so that the connection terminal 32 is inclined independently from the locking pieces 13.

In the embodiment of the present invention, as described above, the locking protrusions 13A-1 of the locking pieces 13 do not receive the abutting force relative to the connection terminal 32. Accordingly, when the connection terminal 32 is inclined, the connection terminal 32 stays at the original location represented with the hidden line shown in FIG. 6, so that the locking protrusions 13A-1 of the locking pieces 13 are maintained inside the locked portion 36 to engage with the inner edges of the locked portion 36. As a result, even when the locked portion 36 is inclined, the locked portion 36 is maintained in the locked state without generating any stress.

The disclosure of Japanese Patent Application No. 2012-105640 filed on May 7, 2012, is incorporated in the application by reference.

While the invention has been explained with reference to the specific embodiments of the invention, the explanation is illustrative and the invention is limited only by the appended claims.

What is claimed is:

1. An inter-terminal connection structure, comprising:

a first circuit board terminal to be mounted on a first circuit board; and a connection connector for connecting the first circuit board terminal, wherein said first circuit board terminal includes a base portion, a pair of contact pieces extending from the base portion, and a pair of locking pieces extending from the base portion, each of said contact pieces includes an elastic arm portion, each of said locking pieces includes a locking portion, said locking portion includes a locking protrusion, said connection connector includes a first connection terminal having a first plate shape portion sandwiched between the contact pieces and the locking pieces, and a first housing that holds the first connection terminal, and said first plate shape portion includes a first locked portion formed as an opening portion or a cut portion at a position corresponding to the locking protrusion so that the locking protrusion is situated in the first locked portion with a play to be movable when the connection connector is attached to the first circuit board terminal.

2. The inter-terminal connection structure according to claim 1, further comprising a second circuit board terminal to be mounted on a second circuit board, wherein said connection connector further includes a second connection terminal having a second plate shape portion for contacting with the second circuit board terminal so that the connection connector electrically connects the first circuit board terminal to the second circuit board terminal when the connection connector is attached to the first circuit board terminal and the second circuit board terminal.

3. The inter-terminal connection structure according to claim 1, wherein said locking pieces are disposed at a position closer to an edge of the first circuit board relative to the contact pieces in a longitudinal direction of the base portion.

4. The inter-terminal connection structure according to claim 1, wherein said locking pieces are disposed at different positions as a plurality of pairs in a longitudinal direction of the base portion.

5. A circuit board terminal to be mounted on a circuit board, comprising:

a base portion;

a pair of contact pieces extending from the base portion; and a pair of locking pieces extending from the base portion, wherein each of said contact pieces includes an elastic arm portion, each of said locking pieces includes a locking portion, and said locking portion includes a locking protrusion so that the locking protrusion is situated in a locked portion of a flat plate portion of a connection connector with a play to be movable when the connection connector is attached to the circuit board terminal.

6. A connection connector for connecting a circuit board terminal, comprising:

a connection terminal having a plate shape portion to be sandwiched between contact pieces and locking pieces of the circuit board terminal; and a first housing that holds the connection terminal, wherein said plate shape portion includes a locked portion formed as an opening portion or a cut portion at a position corresponding to a locking protrusion of the locking piece so that the locking protrusion is situated in the locked portion with a play to be movable when the connection connector is attached to the circuit board terminal.

* * * * *